United States Patent [19]

Robinson

[11] 4,362,003

[45] Dec. 7, 1982

[54] CANTLE SADDLE

[76] Inventor: Michael A. Robinson, Glenburn Star Rte., Fall River Mills, Calif. 96028

[21] Appl. No.: 161,323

[22] Filed: Jun. 20, 1980

[51] Int. Cl.[3] ..... B68C 1/02

[52] U.S. Cl. ..... 54/44

[58] Field of Search ..... 54/37, 44, 45, 46

[56] References Cited

U.S. PATENT DOCUMENTS

| | | | |
|---|---|---|---|
| 717,307 | 12/1902 | Whitman | 54/46 |
| 1,214,364 | 1/1917 | Peterson | 54/46 |
| 3,323,286 | 6/1967 | Le Laurin, Jr. | 54/44 |
| 3,971,194 | 7/1976 | Morgan | 54/66 |

*Primary Examiner*—Paul J. Hirsch
*Assistant Examiner*—Robert P. Swiatek
*Attorney, Agent, or Firm*—Blair, Brown & Kreten

[57] ABSTRACT

Disclosed herein is a cantle saddle defined by a primary major saddle such as an English or Western saddle having a rear portion or cantle area which serves as a nesting site for the addition of a secondary saddle. The secondary saddle has a deformable front area capable of accommodating and nesting against the primary saddle and various techniques for affixing the cantle saddle to the primary saddle depending upon the geometry of the primary saddle are provided.

17 Claims, 4 Drawing Figures

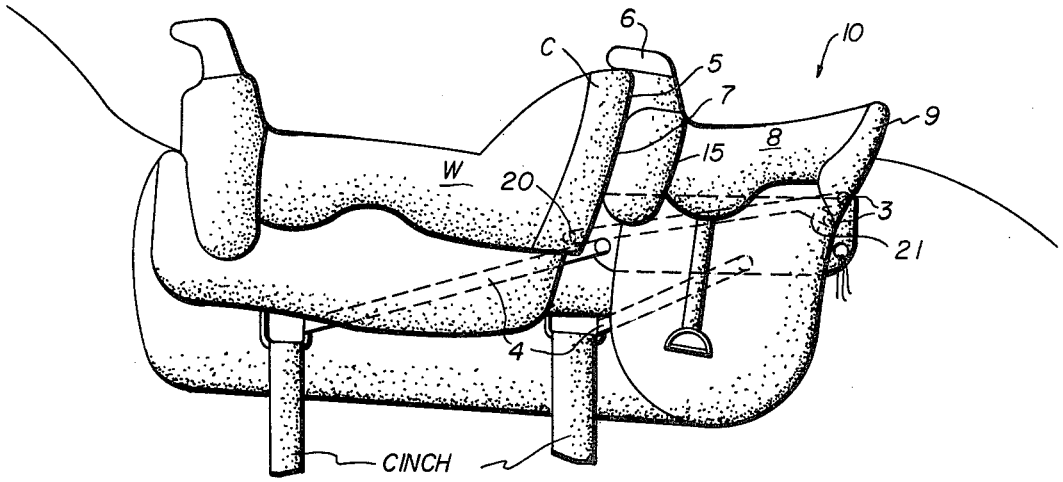
FIG 1
FIG 2
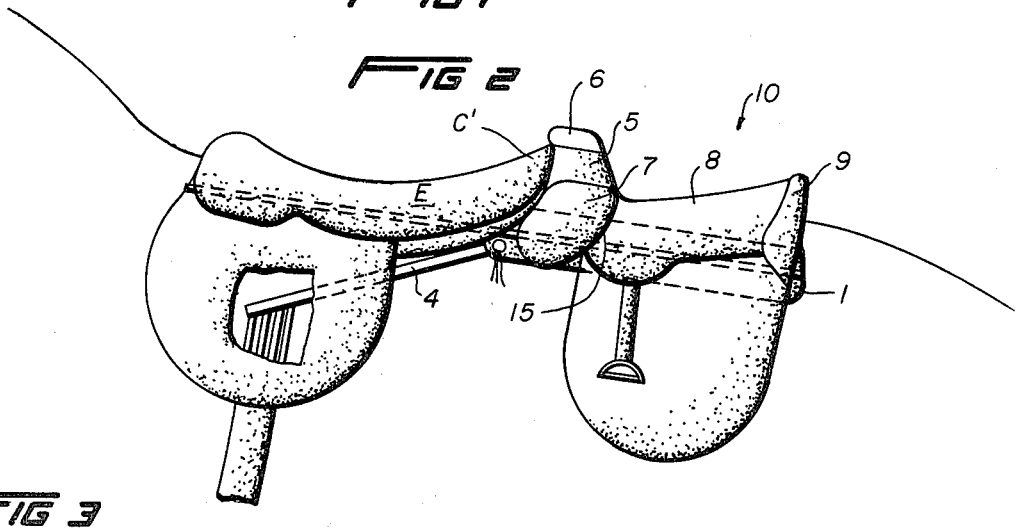
FIG 3
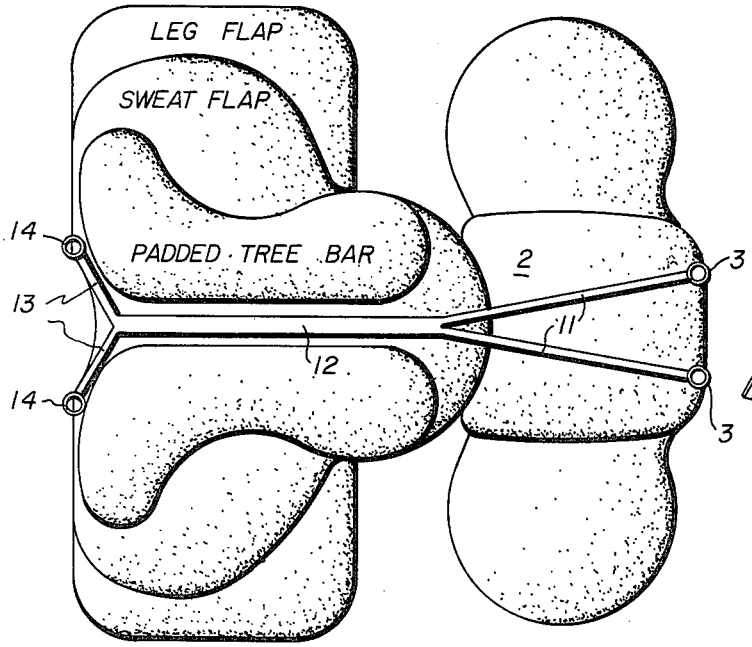
FIG 4
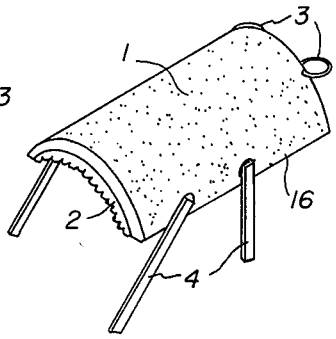

CANTLE SADDLE

BACKGROUND OF THE INVENTION

The art of equitation has become a sport in which the level of competition and demand for greater expertise has dramatically increased over the past decade due to specialization in this art at an earlier age. To this end, it is important for training purposes as well as for pleasure rides to provide young children and trainees with the opportunity for experiencing quality horsemanship and perceive the nuances of expertise at close hand.

The following list of patents reflect the state of the art of which applicant is aware, and the differences between these references and the instant application should become immediately apparent:

U.S. Pat. No. 1,214,364—Peterson
U.S. Pat. No. 3,112,592—Schindler
U.S. Pat. No. 3,234,710—Gauthier
U.S. Pat. No. 3,916,604—Phipps All of these patents may be characterized by noting that none of the adjuncts to the main or primary saddle is disposed behind the primary saddle area, and in general all of these affix in one way or another to or near the saddle horn. Whereas, it should be apparent that form and balance are only partially the concern of a rider, maintaining control of the animal is of paramount importance. To this end, any impediment which would interfere with the primary rider's arm position relative to the horse's reins and bit area can have a detrimental effect in controlling the horse and maintaining proper balance. Clearly, if the student rider is disposed between the arms of the primary rider who loses control of the horse, or at least has momentary imbalances, there would be to the detriment of those riding not only for knowledge, but for pleasure.

Furthermore, it should be apparent that with the child forward of the main rider, the child is no longer able to study as well the primary rider's posture, his ability to react to different situations in riding, and his maintaining the proper form necessary for expertly controlling a horse.

SUMMARY OF THE INVENTION

Accordingly, it is an object of this invention to provide a device for allowing a trainee or a pleasure rider to be so positioned on a horse that the primary rider maintains and develops complete control over the animal irrespective of miscues by the secondary rider. Further, it is important for one to appreciate that given the perspective of the secondary rider, it is much easier to watch and learn different techniques in horse handling.

Accordingly, it is another object of this invention to provide a device of the character described above which is reliably secured to the primary saddle, and durable in construction.

It is a further object of the invention to provide a device of the character described above which is easily installed upon a horse, and relatively inexpensive to manufacture.

It is still another object of this invention to provide a device of the character described above in which a forward or leading edge of the secondary saddle is suitably fashioned to abut against and conform with primary saddles having various contours along the trailing edge or cantle portion thereof.

It is a further object of this invention to provide a device of the character described above which is capable of being disposed upon both English and Western saddles and therefore plural means for affixing are provided.

These and other objects will be made manifest when considering the following detailed specification when taken in conjunction with the appended drawing figures.

BRIEF DESCRIPTION OF THE DRAWINGS

FIG. 1 is a side view of the apparatus according to the present invention when affixed to a Western saddle.

FIG. 2 is a side view of the apparatus according to the present invention when affixed to an English saddle.

FIG. 3 is a bottom view looking upward of the English saddle in FIG. 2 with the parts flattened out.

FIG. 4 is a perspective view of the tree base area of the secondary or cantle saddle showing various ways of affixing this saddle to the primary saddle.

DESCRIPTION OF THE PREFERRED EMBODIMENT

Referring now to the drawings, wherein like reference numerals refer to like parts throughout the various drawing figures, reference numeral 10 is directed to the cantle saddle according to the present invention. This saddle 10 is provided with a tree base 1 having an underlying protective pad 2 removeably attached to the bottom face of the tree base by means of any suitable affixing device such as Velcro TM fasteners. The tree base 1 is provided with means for attaching the secondary or cantle saddle to the primary or main saddle and these means include plural straps 4 running along side edges 16 of the tree base, and ring members 3 disposed along a trailing edge of the tree base.

As shown in FIGS. 1 and 2, the cantle C or C′ of the primary saddle refers to the unique contour for Western and English saddles respectively. The front edge of the secondary saddle is provided with means to conform to the rear contour or cantle area of the primary saddle and this leading edge can be defined as the horn 6 under which is provided a fork 5 and a leading edge 7 of the seating area all of which are affixed to the saddle seat 8 along edge 15. Preferably, the horn 6, fork 5 and leading edge 7 are stuffed with a padded material such as resilient foam which when drawn up against the cantle area of the primary saddle will deform to provide minimal space between the two saddles and assure a tight area of interconnection. The secondary saddle has a seating area 8 and a cantle 9 of its own which overlie the tree base 1. Preferably, the tree base 1 is riveted, stapled or in some other way permanently affixed to the seating area as is well known in leather working art.

For the English saddle, FIG. 3 shows a mechanism by which the secondary or cantle saddle can be affixed thereto. Specifically, a gullet strap 12 made of elastic material runs along the longitudinal centerline of the English saddle on the bottom face thereof. This gullet strap 12 is provided with bifurcated termini, the front ends of which bear the legend 13 and terminate in rings 14 provided on a front edge of the English saddle. The rearward portion of the gullet strap 12 is provided with second bifurcated termini 11 which affix to the rings 3 provided on the trailing edge of the tree base.

This means for affixing tends to provide a downward force and an inward force along the trailing edge of the cantle or secondary saddle, and if desired this retention device may be supplemented by providing a strap 4 extending from the tree 1 to a cinch as shown in FIG. 2. In a Western saddle, a pair of such straps 4 are provided each of which extends to forward and rearward cinches so as to provide the means for attachment. Additionally, elastic cross straps 21 may extend from the rings 3 to tieing devices 20, provided on the cantle lower rear portion.

Having thus described the invention, it should be apparent that numerous structural modifications are contemplated as being a part of this invention as set forth hereinabove and as defined hereinbelow by the claims.

What is claimed is:

1. A cantle equestrian saddle attached solely to rear of a main saddle in which the main saddle is cinched with a girth to the body of a horse comprising in combination:

means on a front face of said cantle saddle to conform to a rear contour cantle area of the main saddle, and means for attaching said cantle saddle exclusively to the main saddle and operatively connected only to the main saddle.

2. The device of claim 1 wherein the main saddle is dimensionally larger than said main saddle.

3. The device of claim 2 wherein said cantle saddle is formed from a tree base, an underlying protective pad removeably attached thereto, and a seating area affixed to a top face of said tree base.

4. The device of claim 3 wherein said cantle saddle's means on a front face thereof to conform to the rear cantle of the main saddle includes a horn and an underlying fork area attached to a leading edge of said seating area, said horn, fork area and leading edge formed from an outer skin within which is contained deformed resilient padding having a memory, whereby placement together of the primary and said cantle saddles causes deformation of said means to conform, but upon separation of said saddles, said cantle saddle returns to an undeformed, unstressed position.

5. The device of claim 4 wherein said padding is foam.

6. The device of claim 5 wherein said underlying protective pad is affixed to said tree base by Velcro TM fasteners.

7. The device of claim 6 wherein said means for attaching said cantle saddle to the main saddle comprises:

strap members extending from side edges of said tree base to cinches on the main saddle.

8. The device of claim 7 wherein said means for attaching said cantle saddle to the main saddle further comprises:

rings on a trailing edge of said tree base, a gullet strap disposed along an underside of the main saddle along a longitudinal centerline thereof, said gullet strap having first and second bifurcated termini, the first of which affixes to a leading edge of the primary saddle, the second of which engages said rings.

9. The device of claim 8 wherein said gullet strap is resilient elastic.

10. The device of claim 7 including elastic straps extending from rings on a trailing edge of said tree base and tieing devices provided on the cantle portion of said main saddle.

11. A secondary equestrian saddle attached to a primary saddle comprising in combination:

means on a front face of said secondary saddle to conform to a rear contour cantle area of the primary saddle, and means for attaching said secondary saddle to said primary saddle wherein said secondary saddle is formed from a tree base, an underlying protective pad removeably attached thereto, and a seating area affixed to a top face of said tree base wherein said secondary saddle's means on a front face thereof to conform to the rear cantle of the primary saddle includes a horn and an underlying fork area attached to a leading edge of said seating area, said horn, fork area and leading edge formed from an outer skin which contains deformable resilent padding having a memory, whereby placement together of the primary and said secondary saddles causes deformation of said means to conform, but upon separation of said saddles, said secondary saddle returns to an undeformed, unstressed position.

12. The device of claim 11 wherein said padding is foam.

13. The device of claim 11 wherein said underlying protective pad is affixed to said tree base by Velcro TM fasteners.

14. The device of claim 13 wherein said means for attaching said secondary saddle to the primary saddlle comprises:

strap members extending from side edges of said tree base to cinches on said primary saddle.

15. The device of claim 14 wherein said means for attaching said secondary saddle to the primary saddle further comprises:

rings on a trailing edge of said tree base, a gullet strap disposed along an underside of the primary saddle along a longitudinal centerline thereof, said gullet strap having first and second bifurcated termini, the first of which affixes to a leading edge fo the primary saddle, the second of which engages said rings.

16. The device of claim 15 wherein said gullet strap is resilient elastic.

17. The device of claim 14 including elastic straps extending from rings on a trailing edge of said tree base and tieing devices provided on the cantle portion of said primary saddle.

* * * * *